US005879752A

United States Patent [19]

Murakami et al.

[11] Patent Number: 5,879,752

[45] Date of Patent: Mar. 9, 1999

[54] METHOD OF COATING A TONER CONVEYOR ROLLER

[75] Inventors: Eisaku Murakami, Hiratsuka; Kazuhiro Yuasa, Zama; Shuichi Endoh, Isehara; Iwao Matsumae, Tokyo; Yoshiaki Tanaka, Kawasaki; Hiroshi Hosokawa, Yokohama; Mugijiroh Uno, Isehara; Hiroshi Saitoh, Ayase; Eiji Takenaka, Atsugi; Toshihiro Sugiyama; Tetsuo Yamanaka, both of Tokyo; Satoru Komatsubara, Atsugi, all of Japan

[73] Assignee: Ricoh Company, Ltd., Tokyo, Japan

[21] Appl. No.: 716,546

[22] Filed: Sep. 19, 1996

Related U.S. Application Data

[62] Division of Ser. No. 566,894, Dec. 4, 1995, Pat. No. 5,617,191.

[30] Foreign Application Priority Data

Dec. 16, 1994 [JP] Japan ..... 6-313461
Aug. 18, 1995 [JP] Japan ..... 7-210549

[51] Int. Cl.[6] ..... B05D 1/28

[52] U.S. Cl. ..... 427/428; 427/466

[58] Field of Search ..... 427/428, 466

[56] References Cited

U.S. PATENT DOCUMENTS 4,533,563 8/1985 Dahlgren et al. ..... 427/387
5,133,998 7/1992 Okazaki et al. ..... 427/428

*Primary Examiner*—Bernard Pianalto
*Attorney, Agent, or Firm*—Oblon, Spivak, McClelland, Maier & Neustadt, P.C.

[57] ABSTRACT

In an electrophotographic image forming apparatus of the type using single-ingredient type high resistance toner, a developing roller or similar toner conveyor roller is covered with a dielectric layer which is comparatively thick at opposite end portions than at an intermediate portion. A conductive or semiconductive elastic layer underlies the dielectric layer. With the above configuration, the dielectric layer is prevented from coming off the roller. This, coupled with the fact that the elastic layer does not contact a photoconductive element, eliminates current leaks and thereby extends the life of the roller and photoconductive element.

18 Claims, 7 Drawing Sheets

METHOD OF COATING A TONER CONVEYOR ROLLER

This is a division, of application Ser. No. 08/566,894 filed on Dec. 4, 1995, U.S. Pat. Ser. No. 5,617,191.

BACKGROUND OF THE INVENTION

The present invention relates to an electrophotographic image forming apparatus of the type using single-ingredient type high resistance toner, and a developing roller or similar toner conveyor roller included in the apparatus.

An electrophotographic image forming apparatus operable with single-ingredient type high resistance toner is advantageous in that, e.g., a developing device and therefore the entire apparatus is small size, and in that maintenance is basically needless. The apparatus can be further miniaturized if an image carrier is implemented as a photoconductive drum. However, with a photoconductive drum, it is difficult to uniformly charge the toner due to the low reliability of the drum.

Two different developing systems using the above toner are available in the imaging art. A first developing system uses an elastic developing roller. The problem with this system is that toner particles charged to the polarity opposite to the expected polarity appear and deposit on and contaminate the background of a sheet. A second developing system has an intermediate roller between a developing roller and a photoconductive element in order to eliminate the above problem. Specifically, the second system protects a sheet from background contamination because when the toner is transferred from the developing roller to the intermediate roller, the toner particles of opposite polarity are left on the developing roller.

Japanese Patent Publication No. 6-64366 proposes an arrangement wherein charged toner of the kind described is conveyed by first conveying means to second conveying means, transferred to the second conveying means by an electrical force, and then conveyed to an image carrier by the second conveying means. The first and second conveying means are implemented as a roller and a belt, respectively, while the image carrier is implemented as a drum. The belt is held in contact with the roller and drum. On the other hand, Japanese Patent Laid-Open Publication No. 6-175477 teaches a toner conveyor roller formed of a soft material and intervening between a hard photoconductive drum and a conveyor roller. This kind of scheme further miniaturizes the apparatus.

In the first developing system, it is necessary to form a layer of uniformly charged toner on the developing roller. The amount of toner must be small enough for the toner to be uniformly charged. If the linear velocity ratio of the toner conveyor roller to a photoconductive element is excessive, the returning force of the toner is excessively increased at the nip while the background is contaminated by, e.g., friction between the photoconductive element and the toner. Further, even when a doctor blade is held in contact with the developing roller in order to charge the toner by friction while regulating the amount of toner, or even when charge is injected into the toner, the amount of toner (for a unit area of the developing roller) which can be uniformly charged is limited. Hence, although the toner may be uniformly charged, the amount of toner deposited on the developing roller and the amount of toner required on the photoconductive element are not always identical. In addition, if the above limit is exceeded, there increases the ratio of toner particles of opposite polarity and uncharged particles to the entire particles. Therefore, at the present stage of development, the apparatus design is required to balance the amount of toner on the developing roller and the linear velocity ratio of the developing roller to the photoconductive element. This eventually does not always result in desirable images.

The above is also true with the second developing system or two-step developing system. Specifically, the developing roller and intermediate roller are each driven at a particular linear velocity. In addition, the linear velocity of the intermediate roller and that of the photoconductive element are often slightly different from each other. Therefore, a stress acts between the developing roller and the intermediate roller and between the intermediate roller and the photoconductive element. Particularly, when the developing roller and intermediate roller are moved in opposite directions at a position where they contact each other, the stress acting there is great. As a result, if the intermediate roller is coated with a dielectric material, the dielectric layer is apt to wear or come off. The dielectric layer often comes off at the end portions thereof. Once the dielectric layer comes off, it is likely that the underlying conductive layer exposed to the outside contacts the photoconductive element, resulting in a current leak. The current leak destroys the dielectric layer and makes the roller unusable.

In the first and second developing systems, the developing roller and intermediate roller (collectively referred to as a toner conveyor roller hereinafter) each contacting the photoconductive element are elastic or soft. While the toner conveyor roller must be semiconductive, it is most desirable that the roller be provided with a dielectric outermost layer and a semiconductive or conductive underlying layer in order to prevent current from leaking at the position where the roller contacts the photoconductive element. For this reason, the conventional toner conveyor roller has a conductive elastic layer, and a dielectric layer formed on the conductive layer. However, the dielectric layer is extremely thin. When the toner conveyor roller and photoconductive element contact each other, the insulation distance between them decreases. As a result, current is apt to leak between the edge of the end portion of the conductive layer and the photoconductive element. Further, the end portion of the conductive layer often bulges out, depending on the production method. When the roller in this condition is coated with a dielectric material, the dielectric layer is reduced in thickness at the end portion thereof. If this kind of roller is held in contact with the photoconductive element, the current leak is aggravated.

As stated above, when use is made of an elastic toner conveyor roller, current leaks due to the peeling of the dielectric layer which is ascribable to a stress acting on the roller, or leaks between the edge of the conductive layer and the photoconductive element on the contact of the roller with the element. The leak not only results in defective images including images with contaminated background, but also destroys the dielectric layer of the roller and that of the photoconductive element and makes them practicably unusable.

SUMMARY OF THE INVENTION

It is therefore an object of the present invention to provide a toner conveyor roller capable of preventing a dielectric layer from peeling and preventing the edge of the end portion of a conductive elastic layer from contacting a photoconductive element, thereby obviating current leaks and enhancing the service life, and an image forming apparatus having the same.

In accordance with the present invention, a toner conveyor roller contacting an image carrier, and for conveying single-ingredient type high resistance toner deposited on the toner conveyor roller to the image carrier, the toner conveyor roller is covered with a dielectric layer forming the outermost layer and having a thickness which is greater at opposite end portions than at the intermediate portion.

Also, in accordance with the present invention, a toner conveyor roller contacting an image carrier, and for conveying single-ingredient type high resistance toner deposited on the toner conveyor roller to the image carrier has a conductive or semiconductive elastic layer, and a dielectric layer covering the elastic layer as an outermost layer. The dielectric layer is extended to the end face of the elastic layer at each end thereof to thereby cover the end face.

Also, in accordance with the present invention, a toner conveyor roller contacting an image carrier, and for conveying single-ingredient type high resistance toner deposited on the toner conveyor roller to the image carrier has a first dielectric layer forming an outermost layer, and a second dielectric layer formed on the end portion of the first dielectric layer.

Also, in accordance with the present invention, a toner conveyor roller contacting an image carrier, and for conveying single-ingredient type high resistance toner deposited on the toner conveyor roller to the image carrier has a conductive or semiconductive elastic layer, a first dielectric layer formed on the elastic layer as an outermost layer, and a second dielectric layer formed on the end portion of the first dielectric layer, and extending to the end face of the elastic layer contiguous with the end portion to thereby cover the end face.

Also, in accordance with the present invention, an image forming apparatus has an image carrier having flanges formed of an insulating material at opposite ends thereof, and for forming a latent image thereon by an electrophotographic process, and a developing device having a toner conveyor roller held in contact with the image carrier, and for causing the toner conveyor roller to convey single-ingredient type high resistance toner deposited thereon to the image carrier to thereby develop the latent image. The toner conveyor roller has a dielectric layer forming an outermost layer, and a conductive or semiconductive layer underlying the dielectric layer. The flanges respectively contact opposite the end portions of the toner conveyor roller when the developing device is located at a predetermined position.

Further, in accordance with the present invention, an image forming apparatus has an image carrier for forming a latent image thereon by an electrophotographic process, a toner conveying member contacting the image carrier, and having on the surface thereof a dielectric layer which is thicker at opposite end portions than at the intermediate portion, and a developing device for supplying single-ingredient type high resistance toner to the image carrier.

Furthermore, in accordance with the present invention, an image forming apparatus has an image carrier for forming a latent image thereon by an electrophotographic process, a developing roller for depositing charged single-ingredient type high resistance toner on the surface thereof, and an intermediate roller having on a surface thereof a dielectric layer which is thicker at opposite end portions than at the intermediate portion, and for causing the toner to be transferred from the developing roller to the intermediate roller, and conveying the toner to the latent image formed on the image carrier.

Moreover, in accordance with the present invention, a method of producing a toner conveyor roller has the steps of preparing a toner conveyor roller for conveying single-ingredient type high resistance toner deposited thereon to an image carrier, and an applying member for applying a dielectric paint for coating to the toner conveyor roller, and moving the applying member back and forth on the surface of the toner conveyor roller along the axis of the roller to thereby apply the dielectric paint to the above surface.

In addition, in accordance with the present invention, a method of producing a toner conveyor roller has the steps of causing an applying member to apply a dielectric paint for coating to the surface of a toner conveyor roller, which conveys single-ingredient type high resistance toner deposited thereon to an image carrier, to thereby form a dielectric layer on the above surface, and causing the applying member to apply the paint to at least one of opposite end portions of the toner conveyor roller where the previous application of the paint has begun.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

To better understand the present invention, a brief reference will be made to conventional developing systems using single-ingredient type high resistance toner, i.e., the first and second systems stated earlier.

Figure 1:
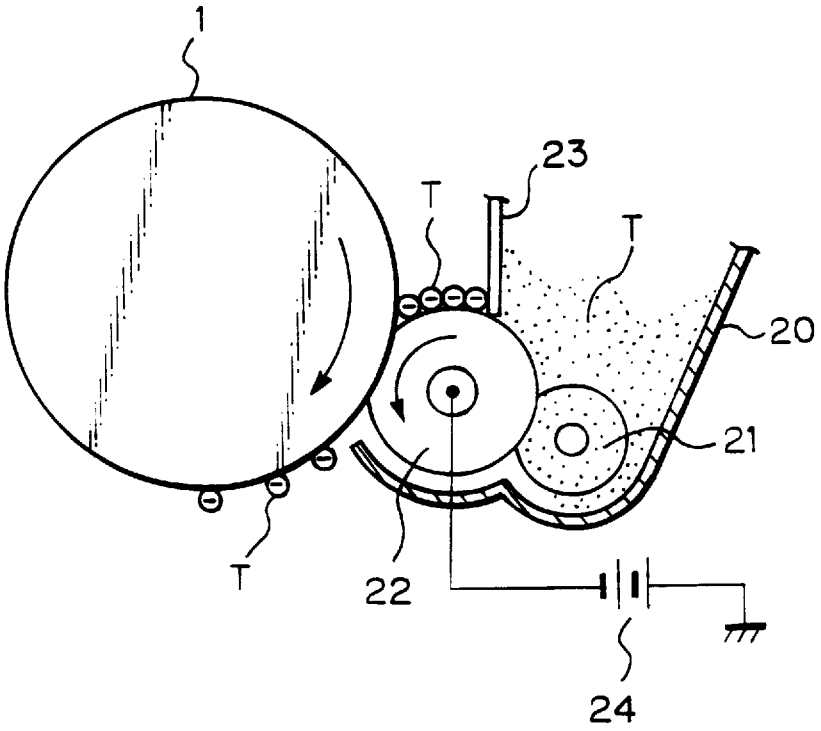
Fig. 1 PRIOR ART
FIG. 1 is a section showing a prior art developing device using an elastic developing roller, i.e., the first developing system.

Referring to FIG. 1 of the drawings, a developing device implemented by the first developing system is shown. As shown, the device adjoins a photoconductive drum 1 and has a hopper storing toner T therein, an elastic developing roller 22 for conveying the toner to a latent image electrostatically formed on the drum 1, a replenishing roller 21 for replenishing the toner T to the roller 22, a doctor blade 23 for leveling the toner T on the roller 22 to thereby form a thin toner layer, and a high-tension power source 24 for applying a bias to the roller 22. The toner T is mainly charged by friction acting between the replenishing roller 21 and the developing roller 22. The bias applied from the power source 24 to the roller 22 causes the toner T to electrostatically adhere to the roller 22. Then, the toner T is conveyed by the roller 22 to a developing position where the roller 22 contacts the drum 1, while being regulated by the blade 23. Because the drum 1 is hard, the roller 22 is formed of an elastic material so as to form a nip for development at the above developing position.

The first developing system has a problem that a part of the toner T is charged to the polarity opposite to the expected polarity and deposited on the background of a sheet, as discussed earlier.

Figure 2:
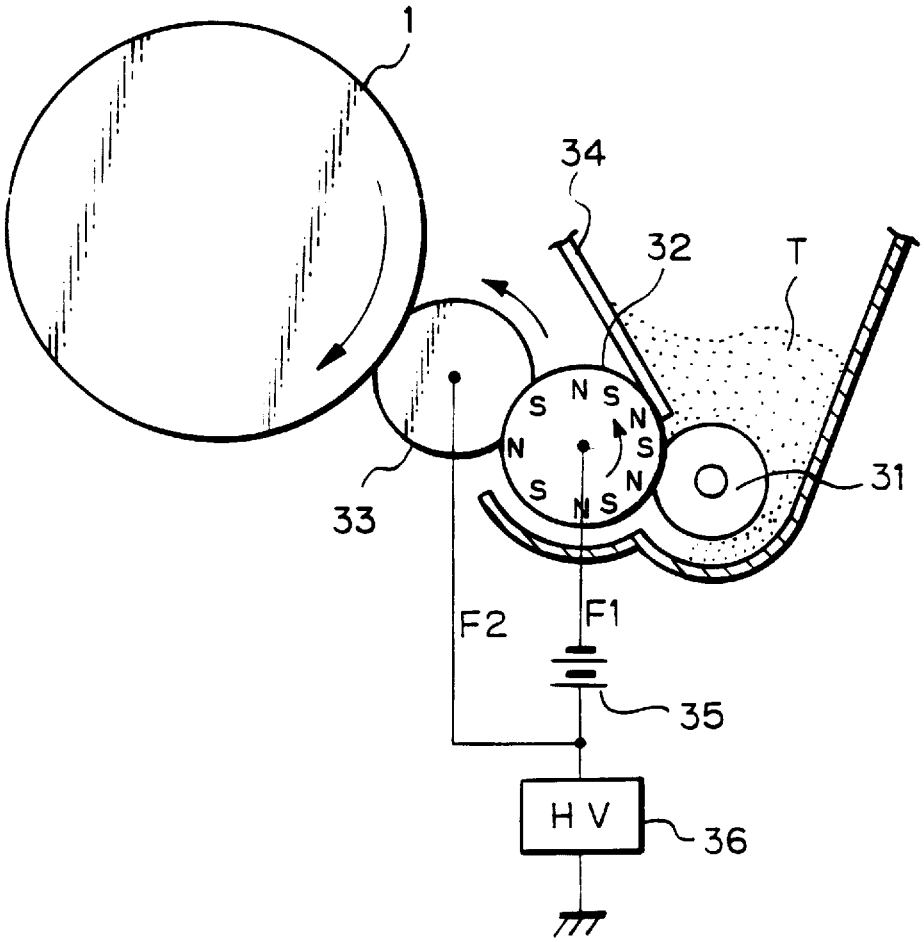
Fig. 2 PRIOR ART
FIG. 2 is a section showing another prior art developing device having an intermediate roller between a photoconductive element and a developing roller, i.e., the second developing system.

FIG. 2 shows a developing device using the second developing system free from the above problem. As shown, the device has a replenishing roller 31 for replenishing the toner T to a developing roller 32. The roller 32 is formed of a hard material and has the surface thereof magnetized, as illustrated. An elastic intermediate roller 33 is held in contact with the roller 32 and the drum 1. A doctor blade 34 is held in contact with the roller 32 at the edge thereof. There are also shown in the figure a power source 35 and a bias source 36 (HV) for development. The intermediate roller 33 is elastically deformed to form a nip between it and the drum 1. The power source 35 is connected to the roller 32 for applying a toner transfer bias F1 (V) thereto. The bias source 36 applies a bias F2 (V) to the roller 33.

Figure 3:
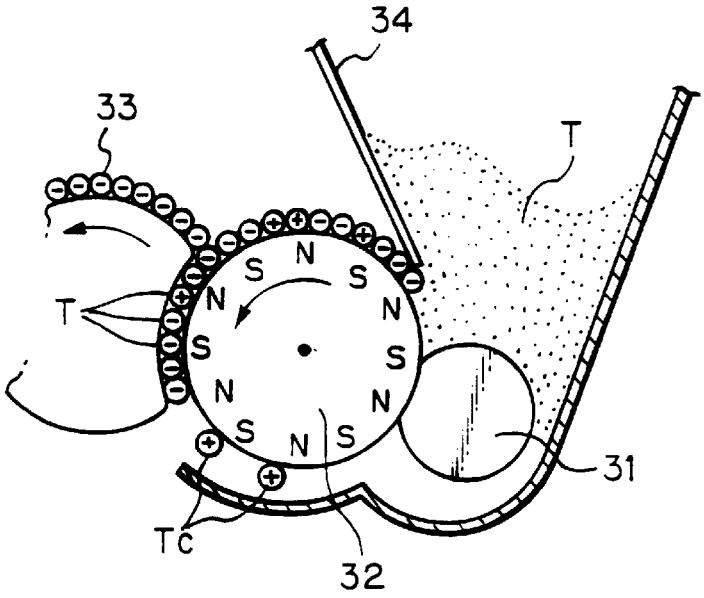
Fig. 3 PRIOR ART
FIG. 3 demonstrates a developing process particular to the device of FIG. 2.

Assume that the toner is chargeable to the negative polarity, and that the device effects negative-to-positive development. The toner T fed from the roller 31 to the roller 32 is magnetically deposited on the roller 32 which is rotating in a direction indicated by an arrow in FIG. 2. The toner T is conveyed toward the roller 33 by the roller 32 while being thinned and frictionally charged by the blade 34. As shown in FIG. 3, the charged toner is electrostatically transferred from the roller 32 to the roller 33 and then conveyed to the nip where the roller 33 and drum 1 contact each other. When the toner T is transferred from the roller 32 to the roller 33, toner particles Tc of opposite polarity are left on the roller 32. This protects the background from contamination attributable to the undesirable particles Tc.

Let the developing roller 22 of FIG. 1 and the intermediate roller 22 of FIG. 2 be collectively referred to as a toner conveyor roller hereinafter. In both of the two different systems described above, the toner conveyor roller is formed of an elastic or soft material. While the toner conveyor roller must be semiconductive, it is most desirable that the roller be provided with a dielectric outermost layer and a semiconductive or conductive underlying layer in order prevent current from leaking at the position where the roller contacts the drum 1.

Figure 4:
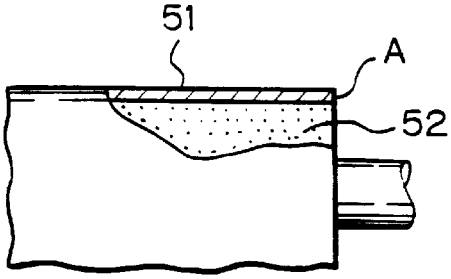
Fig. 4 PRIOR ART
FIG. 4 is a partly sectional fragmentary view showing a specific configuration of the developing roller of FIG. 1 or the intermediate roller of FIG. 2.
Figure 5:
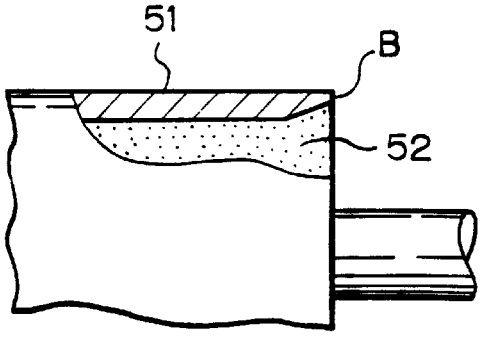
Fig. 5 PRIOR ART
FIG. 5 is a partly sectional fragmentary view showing another specific configuration of the developing roller or the intermediate roller.

FIG. 4 shows one end portion of the above toner conveyor roller in a partly sectional view. As shown, the roller has a conductive elastic layer 52, and a dielectric layer 51 formed on the conductive layer 42. However, the dielectric layer 51 is extremely thin. When the toner conveyor roller and drum 1 contact each other, the insulation distance between them decreases. As a result, current is apt to leak between the edge (labeled A) of the end portion of the conductive layer 52 and the drum 1. Further, as shown in FIG. 5, the end portion of the conductive layer 52 often bulges out, depending on the production method. When the roller in this condition is coated with a dielectric material, the resulting dielectric layer 51 is reduced in thickness at the end portion of the roller (labeled B). If this kind of roller is held in contact with the drum 1, current is more likely to leak than in the condition shown in FIG. 4.

As stated above, when use is made of an elastic toner conveyor roller, current leaks due to the peeling of the dielectric layer 51 which is ascribable to s stress acting on the roller, or leaks between the edge of the conductive layer 52 and the drum 1 on the contact of the roller with the drum 1. The leak not only results in defective images including images with contaminated background, but also destroys the dielectric layer of the roller and that of the drum 1 and makes them practicably unusable.

Figure 6:
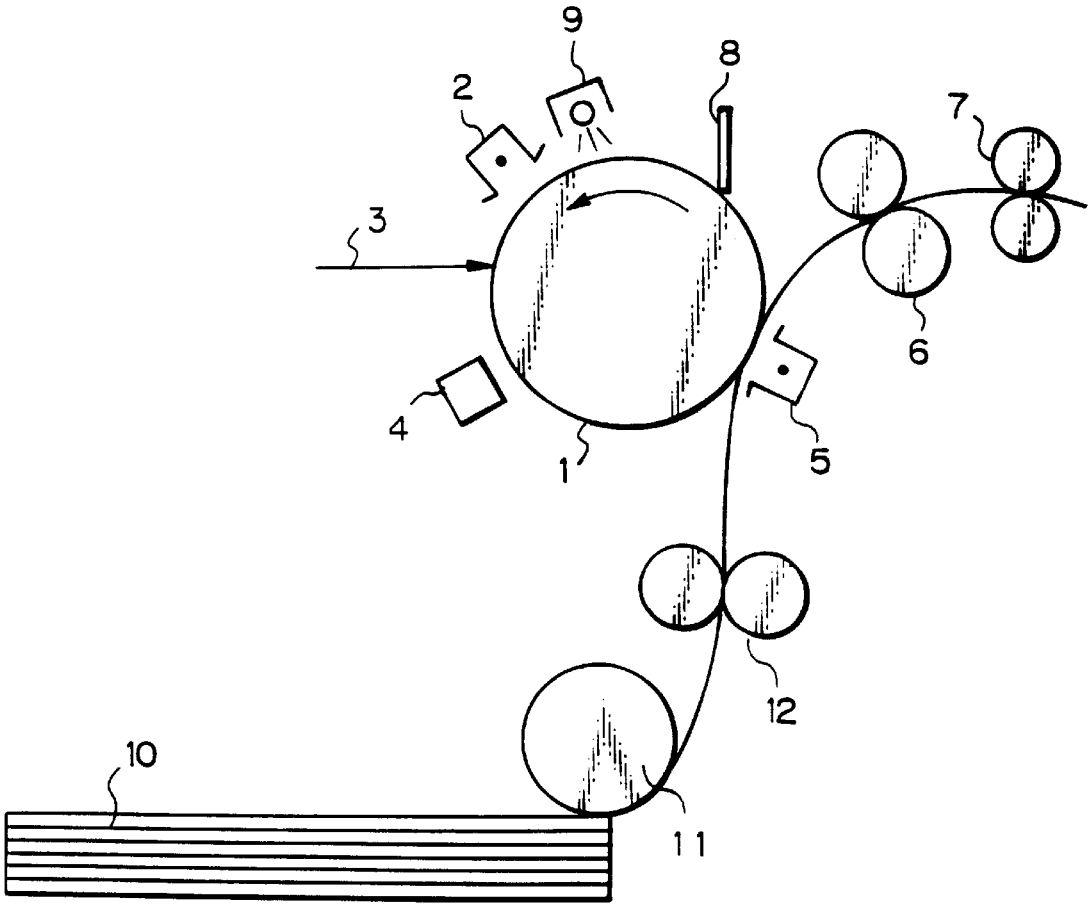
FIG. 6 shows the basic construction of an image forming apparatus in accordance with the present invention.

Referring to FIG. 6, the basic construction of an image forming apparatus embodying the present invention is shown. As shown, the apparatus has an image carrier implemented as a photoconductive drum 1. A charger 2 uniformly charges the surface of the drum 2. An arrow 3 is representative of an optical writing unit for exposing the charged drum 1 and thereby electrostatically forming a latent image thereon. A developing unit 4 transfers single-ingredient type high resistance toner to the latent image so as to form a corresponding toner image. An image transfer unit 5 transfers the toner image to a sheet. A fixing unit 6 fixes the toner image on the sheet. An outlet roller pair 7 drives the sheet coming out of the fixing unit 6 to the outside of the apparatus. A cleaning unit 8 removes the toner left on the drum 1 after the image transfer. A discharger 9 dissipates the charge also left on the drum 1 after the image transfer and thereby initializes the drum 1. A pick-up roller 11 feeds cut sheets 10 to a registration roller pair 12 one at a time. The registration roller pair 12 once stops the sheet and then drives it toward the image transfer unit 5 at a predetermining timing. While the developing unit 4 may basically have any one of the configurations shown in FIGS. 1 and 2, let the following description concentrate on the two-step configuration of FIG. 2 by way of example.

In operation, the drum 1 is rotated counterclockwise as viewed in FIG. 6. While the charger 2 uniformly charges the surface of the drum 1, the writing unit 3 exposes the charged surface of the drum 1 imagewise and thereby forms a latent image. The developing unit 4 selectively feeds the toner to the latent image so as to form a corresponding toner image. The toner image is brought into contact with the sheet 10 conveyed to the image transfer unit 5 by the pick-up roller 11 and registration roller pair 12. As a result, the toner image is transferred from the drum 1 to the sheet 10. The sheet 10 carrying the toner image thereon is conveyed to the fixing unit 6. The sheet 10 having the toner image fixed by the unit 6 is driven out of the apparatus by the roller pair 7 as a hard copy.

The toner left on the drum 1 after the image transfer is collected by the cleaning unit 8 while the charge also left on the drum 1 is dissipated by the discharger 9. The drum 1 with a surface potential of substantially zero volt again reaches the charger 2. The above procedure may be repeated to produce a desired number of hard copies.

Referring again to FIG. 2, in the event of development, the developing roller 32 and intermediate roller 33 both rotate counterclockwise while the drum 1 rotates clockwise. First, the replenishing roller 31 in rotation drives the toner T to immediately below the roller 32. Because the toner is magnetic, it is deposited on the magnetized surface of the roller 32 and conveyed thereby. The metallic blade 34 frictionally charges the toner on the roller 32 to the negative polarity, while regulating the thickness thereof, as stated earlier.

The roller 33 has a higher surface potential than the roller 32. Hence, the toner of negative polarity is transferred from the roller 32 to the roller 33 at the position where the rollers 32 and 33 contact each other. Further, the portion o f the drum 1 charged by the charger 2 is lower in surface potential than the roller 33, but the latent image portion of the drum 1 is higher in surface potential than the roller 33. As a result, the toner is transferred from the roller 33 only to the latent image portion of the drum 1, thereby forming a corresponding toner image. Although toner particles of positive polarity may exist on the surface of the roller 32, they are not transferred to the roller 33 because the roller 33 has a higher surface potential than the roller 32, as mentioned above.

The toner image is transferred from the drum 1 to the sheet by the image transfer unit 9, fixed on the sheet, and then driven out, as stated previously.

Figure 7:
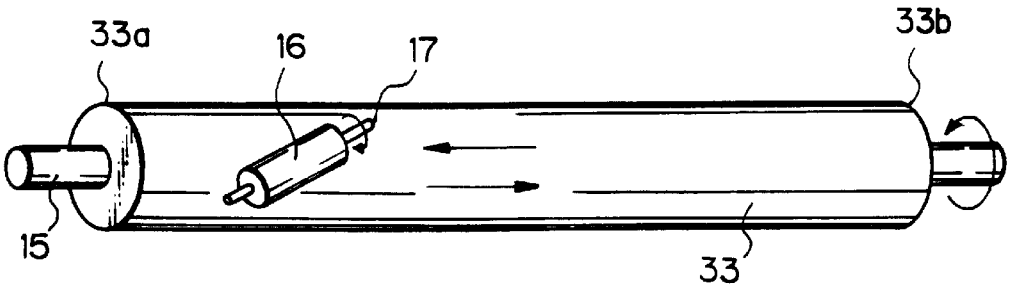
FIG. 7 shows how a dielectric layer is formed on the intermediate roller.

FIG. 7 shows a method of forming a dielectric layer on the intermediate roller 33. As shown, the roller 33 is rotatable about a shaft 15 thereof. There are also shown in the figure an applicator roller, or applying means, 16, and a shaft 17 of the applicator roller 16. First, the roller 33 is mounted to a jig, not shown. Then, the applicator roller 16 is brought into contact with the circumferential surface of one end of the roller 33. In this condition, the shaft 15 is rotated in a direction indicated by an arrow in the figure. As a result, the applicator roller 16 is rotated about the shaft 17 while applying a fluorine-based paint to the roller 33. At the same time, the applicator roller 16 is sequentially moved along the axis of the roller 33 while controlling the amount of application. Consequently, the paint is applied to the roller 33 in a spiral pattern. One end portion of the roller 33 where the application begins and the other end portion where the application ends will be respectively referred to as a beginning 33*a* and an end 33*b* hereinafter.

As shown in FIG. 2, the surfaces of the two rollers 32 and 33 move in opposite directions to each other, as viewed at the contact position. This, coupled with the fact that the roller 33 is soft, causes the roller 33 to deform at the contact position. As a result, a stress acts on the surface or dielectric layer 51 (FIGS. 4 and 5) of the roller 33, causing the layer 51 to crack or peel easily, particularly at opposite ends thereof.

Why the surfaces of the rollers 32 and 33 are caused to move in opposite directions at the contact position is as follows. By increasing the linear velocity ratio of the roller 33 to the drum 1, it is possible to supply a greater amount of toner to the drum 1 and set up a desired image density. However, an increase in the linear velocity of the roller 33 is apt to wear the photoconductive layer of the drum 1 and to strip off the toner from the drum 1 due to the difference in velocity. When the rollers 32 and 33 are moved in opposite directions at the contact position, a greater amount of toner can be fed to the roller 33 by a mechanical force (stripping force) combined with the conventional electric field. Therefore, it is possible to increase the amount of toner supply to the drum 1 without increasing the linear velocity ratio of the roller 33 to the drum 1.

Figure 8:
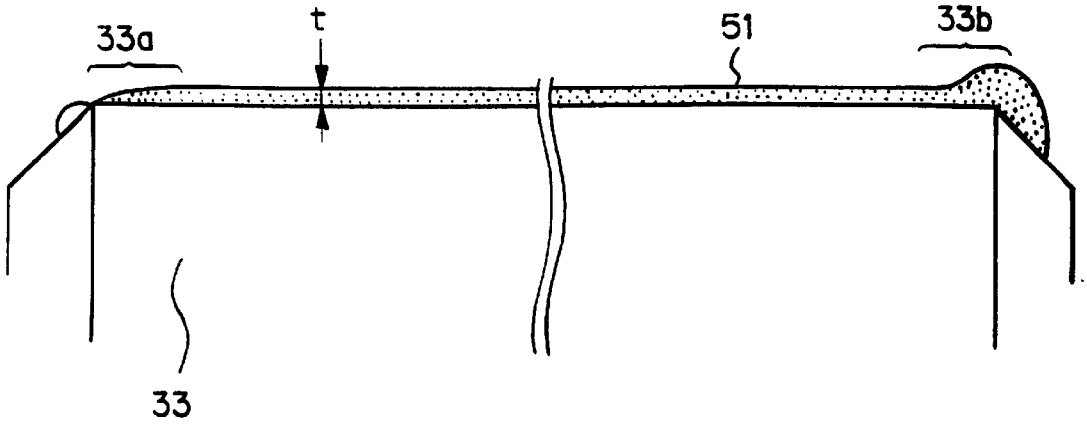
FIG. 8 shows a dielectric layer formed from one end to the other end of the intermediate roller by coating.

As shown in FIG. 7, when the applicator roller 16 is moved on and along the surface of the roller 33 while controlling the amount of application, it squeezes the paint. Consequently, as shown in FIG. 8, the dielectric layer 51 has a thickness t varying from the beginning 33*a* to the end 33*b*. In this condition, a crack is apt to appear at the beginning 33*a*, where the coating is thin, due to the stress repeatedly acting on the roller 16.

Figure 9A:
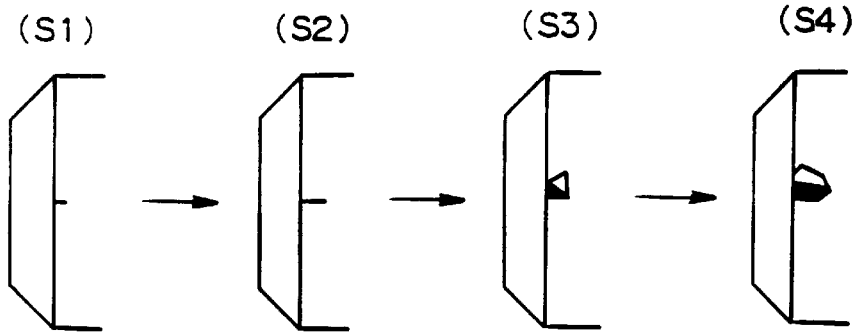
FIGS. 9A and 9B demonstrate how a crack appears and grows.
Figure 9B:
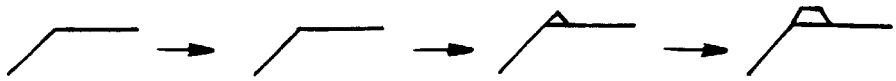

FIGS. 9A and 9B demonstrate how a crack appears at the beginning 33*a* of the dielectric layer 51 and sequentially grows. FIGS. 9A and 9B show the roller 33 in atop plan view and a side elevation, respectively. As shown, a crack appears at the beginning 33*a* (S1), grows (S2), and then slightly comes off to form a small split (S3). Subsequently, the split grows (S4). Finally, the layer 51 peels off over the entire circumference and then over the entire axis of the roller 33.

For example, the dielectric layer 51 was formed on the roller 33 to a thickness of about several microns at the beginning 33*a*, to a thickness of about a hundred and several tens of microns at the end 33*b*, and to a thickness of about 20 microns at the intermediate portion. The rollers 32 and 3 3 were respectively rotated at linear velocities of 227.6 mm/sec and 73.7 mm/sec while biting into each other by 0.35 mm. As a result, a crack appeared at the beginning 33*a* in about 5 hours, grew to form a split in about 6 hours, and caused the layer 51 to come off in the circumferential direction in about 20 hours.

In light of the above, the applicator roller 16, FIG. 7, was moved back and force twice between the beginning 33*a* and the end 33*b* such that the dielectric layer 51 was about a hundred and several tens of microns thick at the beginning 33*a* and end 33*b* and about 40 microns thick at the intermediate portion. The rollers 32 and 33 were operated under the same conditions as stated above. This is a first example of the dielectric layer forming method in accordance with the present invention. The first example did not cause even a crack to appear when the rollers 32 and 33 were driven for more than 100 hours.

When the applicator roller 16 applies the paint to the roller 33 while moving back and force, as stated above, both end portions of the roller 33 are increased in thickness due to the dielectric layer 51, but they are prevented from being excessively thin. In addition, the layer 51 is free from noticeable irregularities in thickness in the axial direction of the roller 33. Hence, the resistance of the layer 51 to peeling is enhanced.

A second example of the dielectric layer forming method of the present invention will be described. In this embodiment, after the applicator roller 16 was moved from the beginning 33*a* to the end 33*b*, FIG. 7, the paint applied to the roller 33 was dried. Then, the applicator 16 applied the paint to the beginning 33*a* for a reinforcing purpose. The resulting layer 51 was about a hundred and several tens of microns thick at the beginning 33*a* and end 33*b* and about 20 microns thick at the intermediate portion. The rollers 32 and 33 were driven under the same conditions as stated above. This example, like the first example, successfully prevented even a crack from appearing in the layer 51 when the rollers 32 and 33 were driven for more than 100 hours.

As stated above, by double-coating both ends of the roller 33, it is also possible to enhance the resistance of the layer 51 to peeling. Particularly, the second example is desirable when the dielectric layer 51 should be reduced in thickness; that is, it is capable of reducing the thickness of the layer 51, compared to the first example which repeatedly applies the paint to the entire roller 33. Further, while a change in the thickness of the layer 51 directly translates into a noticeable change in developing characteristic, the second embodiment realizes an anti-peeling implementation without resorting to the alteration of a system design, i.e., with existing specifications.

In the above examples, the shaft 15 of the roller 33 should preferably be held in a horizontal position during the course of coating operation in order to stabilize the application. In the second example, the paint may be applied only to the beginning 33*a* for reinforcement first, and then applied to the entire roller 16 from the beginning 33*a* to the end 33*b*. The applicator roller 16 may, of course, be replaced with a brush, scraper or similar member so long as it can regulate the amount of application.

Figure 10:
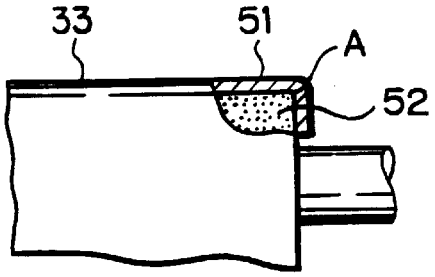
FIGS. 10–12 are partly sectional views respectively showing a first to a third embodiment of the intermediate roller in accordance with the present invention.

A first embodiment of the roller 33 will be described with reference to FIG. 10. As shown, the end of the dielectric layer 51 shown in FIG. 4 is extended to the end face of the underlying conductive layer 52 over the edge A. This kind of configuration prevents current from leaking from the end of the roller 33 to the drum 1.

Figure 11:
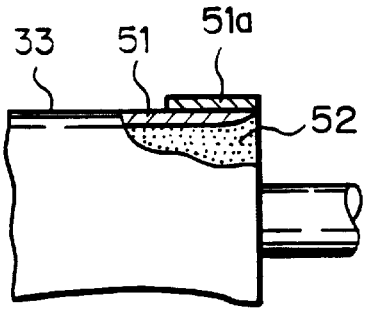

FIG. 11 shows a second embodiment of the roller 33. As shown, the roller 33 has a dielectric layer 51*a* at the end portion thereof in addition to the layer 51. The layer 51*a* overlying the layer 51 reinforces the portion of the layer 51 overlying the bulged portion of the elastic layer 52. With this structure, the roller 33 prevents current from leaking from the end thereof to the drum 1 even when the end configuration of the layer 52 is not accurate. The layers 51 and 51*a* may be formed of the same material or of different materials so long as they are dielectric.

Figure 12:
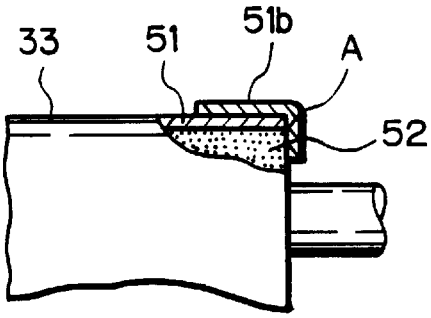

FIG. 12 shows a third embodiment of the roller 33. As shown, a dielectric material is applied to the end portion of the dielectric layer 51 shown in FIG. 10 and extended to the end face of the conductive layer 52 over the edge A, thereby forming a dielectric layer 51*b*. With this structure, the roller 33 prevents current from leaking from the end thereof to the drum 1. This is true even when the end configuration of the roller 33 is not accurate. Again, the layers 51 and 51*b* may be formed of the same material or of different materials so long as they are dielectric.

Figure 13:
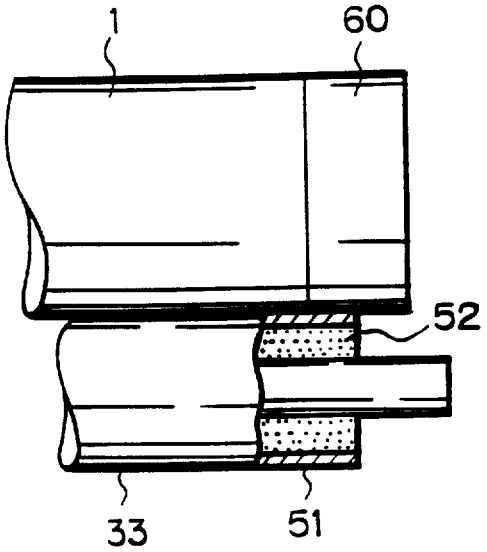
FIG. 13 is a partly sectional view of an embodiment of the photoconductive element in accordance with the present invention.

As shown in FIG. 13, the drum 1 may be provided with a flange 60 made of an insulating material at each end thereof. If the roller 33 is held in contact with the flange 60, it is possible to obviate a current leak from the end portion of the roller 33 to the drum 1 without processing the end portion of the roller 33. The roller 33 may, of course, be provided with any one of the configurations of the above embodiments, if desired.

Figure 14:
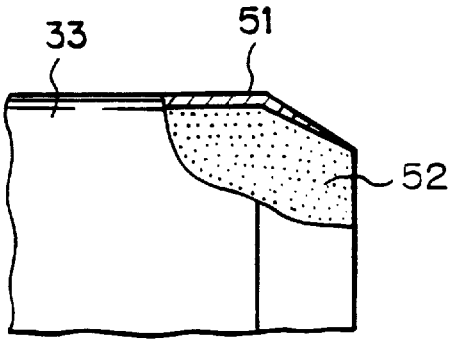
FIG. 14 is a partly sectional view showing another embodiment of the intermediate roller or toner conveyor roller in accordance with the present invention.

The prerequisite with the first to third embodiments of the roller 33 is that the edge of the roller end portion be covered with a dielectric layer. Hence, when the edge of the roller 33 is tapered, as shown in FIG. 14, the dielectric layer 51 should only cover the tapered portion of the roller 33; that is, it is not necessary to extend the layer 51 to the end face of the conductive layer 52 over the tapered portion.

The specific methods of producing the roller 33 and the specific configurations of the roller 33 described above are also applicable to the developing roller 22 included in the developing device of FIG. 1.

In summary, it will be seen that the present invention has various unprecedented advantages, as enumerated below.

(1) A toner conveyor roller is covered with a dielectric layer which is comparatively thick at opposite end portions thereof. The dielectric layer is therefore reinforced at the opposite end portions and free from cracking, peeling, etc. In addition, the insulation distance between the toner roller and an image carrier is great enough to prevent current from leaking, thereby obviating defective images and a decrease in service life.

(2) The dielectric layer is extend to the end face of the roller. Assume that when the roller is brought into contact with the image carrier, a conductive or semiconductive elastic layer tends to contact the image carrier due to the elastic deformation of the roller. Then, the above dielectric layer intervening between the edge of the elastic layer and the image carrier prevents the elastic layer from contacting the image carrier, so that a current leak is obviated.

(3) A second dielectric layer is formed on the above or first dielectric layer at opposite end portions of the roller. As a result, the first layer is protected from cracking, peeling and other undesirable occurrences, and therefore free from current leaks.

(4) The second layer is extended to the end face of the roller and obviates current leaks which would bring about cracking, peeling, etc. In addition, because the elastic layer does not contact the image carrier, current is prevented from leaking between the edge of the end of the elastic layer and the image carrier.

(5) When the roller is held in contact with insulative flanges provided on opposite ends of the image carrier, the elastic layer is prevented from contacting the image carrier. This also eliminates current leaks. The flanges may play the role of a part of an image carrier driveline, if desired.

(6) Only if applying means is moved back and forth on the periphery of the roller in the axial direction of the roller, the dielectric layer can be provided with a greater thickness at opposite ends thereof than at the intermediate portion.

(7) After the applying means has applied a paint to the roller in order to form the dielectric layer, it again applies the paint to the end portion of the roller where the previous application has begun. This provides the dielectric layer with a greater thickness at opposite end portions than at the intermediate portion, while maintaining the intermediate portion uniform in thickness. Hence, the thickness of the dielectric layer can be set with ease.

(8) When the applying means is implemented as a roller, it squeezes the paint applied to the roller, and therefore applies it more uniformly.

Various modifications will become possible for those skilled in the art after receiving the teachings of the present disclosure without departing from the scope thereof.

What is claimed is:

1. A method of coating a toner conveyor roller with a dielectric paint, comprising the steps of:

preparing a toner conveyor roller having longitudinal axis for conveying toner deposited thereon to an image carrier by moving one of said toner conveyor roller and an applying means for applying said dielectric paint to said toner conveyor roller into engagement with each other; and moving said applying means back and forth on a surface of said conveyor roller in opposite directions parallel to the longitudinal axis of said toner conveyor roller to apply the dielectric paint from the applying means to said surface.

2. The method as claimed in claim 1, wherein said applying means comprises an applicator roller.

3. The method as claimed in claim 2, further comprising inclining a longitudinal axis of said applicator roller relative to the longitudinal axis of said toner conveyor roller by a predetermined degree.

4. The method of claim 2, further comprising providing said applicator roller with a length shorter than a length of said toner conveyor roller.

5. The method of claim 4, further comprising inclining a longitudinal axis of said applicator roller relative to the longitudinal axis of said toner conveyor roller by a predetermined degree.

6. The method of claim 5, further comprising rotating said applicator roller while moving said applicator roller in said opposite directions.

7. The method as claimed in claim 2, further comprising rotating said toner conveyor roller while applying the dielectric paint to said toner conveyor roller.

8. The method as claimed in claim 2, further comprising providing the longitudinal axis of said toner conveyor roller in a horizontal position while applying the dielectric paint to said toner conveyor roller.

9. The method as claimed in claim 2, further comprising providing the dielectric paint on said toner conveyor roller with a greater thickness at opposite end portions thereof than at other portions.

10. A method of coating a toner conveyor roller, comprising the steps of:

causing applying means to apply a dielectric paint to coat a surface of a toner conveyor roller with a dielectric layer; and then causing said applying means to again apply the dielectric paint to at least one of opposite end portions of said toner conveyor roller already having a coat of dielectric paint.

11. The method as claimed in claim 10, wherein said applying means comprises an applicator roller.

12. The method as claimed in claim 11, further comprising inclining a longitudinal axis of said applicator roller relative to the longitudinal axis of said toner conveyor roller by a predetermined degree.

13. The method 11, further comprising providing said applicator roller with a length shorter than a length of said toner conveyor roller.

14. The method of claim 13, further comprising inclining a longitudinal axis of said applicator roller relative to the longitudinal axis of said toner conveyor roller by a predetermined degree.

15. The method of claim 14, further comprising rotating said applicator roller while moving said applicator roller in said opposite directions.

16. The method as claimed in claim 11, further comprising rotating said toner conveyor roller while applying the dielectric paint to said toner conveyor roller.

17. The method as claimed in claim 11, further comprising providing the longitudinal axis of said toner conveyor roller in a horizontal position while applying the dielectric paint to said toner conveyor roller.

18. The method as claimed in claim 11, further comprising providing the dielectric paint on said toner conveyor roller with a greater thickness at opposite end portions thereof than at other portions.

* * * * *